US009168640B2

(12) United States Patent
Stanley

(10) Patent No.: US 9,168,640 B2
(45) Date of Patent: Oct. 27, 2015

(54) HOLDER FOR SHARPENING AND FACETING

(71) Applicant: Harrelson Stanley, Pepperell, MA (US)

(72) Inventor: Harrelson Stanley, Pepperell, MA (US)

( * ) Notice: Subject to any disclaimer, the term of this patent is extended or adjusted under 35 U.S.C. 154(b) by 99 days.

(21) Appl. No.: 14/085,390

(22) Filed: Nov. 20, 2013

(65) Prior Publication Data

US 2015/0140909 A1 May 21, 2015

(51) Int. Cl.

| | |
|---|---|
| ***B24D 15/06*** | (2006.01) |
| ***B24B 15/08*** | (2006.01) |
| ***B24D 15/08*** | (2006.01) |
| ***B24D 15/10*** | (2006.01) |
| ***B24B 41/06*** | (2012.01) |
| *B24B 3/36* | (2006.01) |

(52) U.S. Cl.

CPC ..... *B24D 15/06* (2013.01); *B24B 15/08* (2013.01); *B24B 41/065* (2013.01); *B24D 15/08* (2013.01); *B24D 15/105* (2013.01); *B24B 3/36* (2013.01)

(58) Field of Classification Search

CPC ..... B24B 3/36; B24B 3/38; B24B 3/48; B24B 3/52; B24B 3/54; B24B 3/55; B24B 3/56; B24B 3/58; B24B 41/06; B24B 41/065; B24D 15/06; B24D 15/08; B24D 15/063; B24D 15/105

See application file for complete search history.

(56) References Cited

U.S. PATENT DOCUMENTS

| | | | | |
|---|---|---|---|---|
| 2,370,908 | A * | 3/1945 | Llorens | 451/378 |
| 3,950,899 | A * | 4/1976 | Gilbert | 451/370 |
| 5,527,208 | A * | 6/1996 | Blake et al. | 451/367 |
| 5,810,649 | A * | 9/1998 | Oar et al. | 451/378 |
| 7,052,385 | B1 * | 5/2006 | Swartz | 451/367 |
| 7,056,195 | B2 * | 6/2006 | Evans | 451/45 |
| 7,549,910 | B2 * | 6/2009 | Stanley | 451/45 |
| 7,553,216 | B2 * | 6/2009 | Hyde et al. | 451/45 |

* cited by examiner

*Primary Examiner* — Timothy V Eley

(74) *Attorney, Agent, or Firm* — Robert R. Deleault, Esq.; Mesmer & Deleault, PLLC

(57) ABSTRACT

A holder for sharpening and faceting includes a cylindrical body having a first end, a second end and an opening formed transversely through the body between the first end and the second end. The opening has a tool support surface. An adjustable clamping component has a rotatably adjustable fastening plate positioned within the opening, where the fastening plate has a top surface and a tool engaging surface to hold the tool against the tool support surface and a plurality of predefined plate end openings. A plurality of roller members are disposed within a longitudinal raceway formed in a lower portion of the body below the opening. The roller members are aligned to roll parallel to the longitudinal axis of the cylindrical body and the axis of rotation of the roller members is perpendicular to the longitudinal axis of the cylindrical body.

7 Claims, 6 Drawing Sheets

HOLDER FOR SHARPENING AND FACETING

BACKGROUND OF THE INVENTION

1. Field of the Invention

The present invention relates generally to tool holders. Particularly, the present invention relates to holders for sharpening and faceting. More particularly, the present invention relates to honing guides and tool grinding rests.

2. Description of the Prior Art

The traditional method of faceting gemstones and/or glass includes first mounting a gem crystal on a metal dowel, (i.e. "dop" or "dopstick'). The dop fits into one end of a quill. The opposite end of the quill is pivotably attached to a vertical mast mounted near the edge of a horizontal, rotating abrasive disk. The user adjusts the height of the quill to achieve the desired angle with respect to the abrasive disk. The user then touches the gem crystal to the rotating abrasive disk to create facets in the gem crystal. The user facets the crown of the stone first, followed by the pavilion. Due to lockable predetermined settings of height, angle, and index, the desired facets are cut/formed into the stone.

The height determines the depth to which a facet is cut, enabling the user to create even, uniform rows of facets of the same size and depth. The angle determines the plane of each facet cut in the stone. The index determines placement of the facets around the stone and enables the user to cut facets that result in the overall shape and appearance of the stone, such as round brilliant cut or emerald cut. The placement and angle of the facets determine the brilliance of the stone due to optical properties and reflection of light through the stone.

The steps applied to faceting gemstones can also be applied to other objects. A simple form of faceting is the act of sharpening a single cutting edge of a tool. In such faceting operations, which are more commonly referred to as sharpening or honing, it is common to use jigs to hold the tool at a predetermined angle to a grind stone. Typically, the grind stones are water cooled. The grinding jigs usually include a roller that supports a plate upon which the tool is secured. The support plate holds the tool at a selected angle against the stone surface. As the stone is moved, the cutting edge is ground or honed at the selected angle. The initial setting of the tool in the jig was critical to the success of the operation.

The present use of such guides is now customarily limited to flat bench stones. The skilled artisan, however, differentiates between grinding and honing. Grinding is considered as defining the basic edge and honing considered as refining the basic edge to the finished sharp edge. In the normal sharpening process, the edge to be sharpened is initially passed over the coarse stone at a selected angle. This process leaves a ragged edge of the desired angle. The bevel is then refined over a stone of finer particles. Since such stones cut more slowly, the work is done on the part of the bevel which intersects with the face of the tool to provide a micro-bevel.

The micro-bevel selected should be a function of the tool material, the material to be cut and the intended use. Ideally, the bevel angle should be no greater than is necessary to prevent the edge from breaking down so that the wedging action of the tool is minimized as the edge enters the material to be cut.

When manually sharpening a tool's cutting edge, the skilled artisan uses a variety of methods that include oil stones, water stones, sandpaper, loose grit or paste on glass, etc. Honing stones typically have a rectangular shape. When using an oil stone, a small amount of lightweight honing oil is usually placed on the honing stone. The skilled artisan then pulls or pushes the cutting edge over the honing stone at the desired angle as if the cutting edge were scrapping the surface of the honing stone, i.e. the cutting edge is pushed or pulled over the honing surface in a perpendicular fashion to the cutting edge. Several blade holders have been devised that facilitate manual sharpening of a cutting edge over a honing surface.

U.S. Pat. No. 4,733,501 (1988, McLean) discloses a honing guide. The honing guide includes a tool support plate mounted above a surface-engaging roller. The surface engaging roller is mounted eccentrically so that the height of the tool support plate may be varied to provide a range of honing angles without unclamping the tool from the guide.

U.S. Pat. No. 5,472,375 (1995, Pugh) discloses a blade sharpening angle guide. The blade sharpening guide includes an elongated curved block having a longitudinal slot therethrough. The longitudinal slot releasably holds a knife blade with the blade cutting edge extending a distance outside the slot.

U.S. Pat. No. 6,030,281 (2000, Cozzini et al.) discloses a sharpening apparatus. The sharpening apparatus includes a base member on which a sharpening stone is positioned. A slidable blade guide member is slidably connected to the base member and includes a guide surface that is disposed at an angle relative to the upper surface of the sharpening stone and a mounting mechanism for removably mounting a spatula against the guide surface such that the scraping edge of the spatula is in engagement with the sharpening stone. The slidable blade guide member is manually slidable back and forth to sharpen the scraping edge of the spatula. A fixed blade guide member is also attached to the base member. The fixed blade guide member includes a horizontal slot that is adapted to receive the shaft of a grill scraper. The fixed blade guide member is adapted to provide guided back and forth sliding movement of the grill scraper within the slot and engagement with the sharpening member to sharpen the scraping edge of the grill scraper.

The above-described devices require the cutting edge of the tool to move over and against the sharpening/honing stone in a "scraping" motion. In other words, the motion of the cutting edge to the stone surface is similar to the action used with a scraper/tool. The motion of the cutting edge of the cutting tool against the honing stone surface is perpendicular to the longitudinal axis of the cutting edge.

SUMMARY OF THE INVENTION

Unfortunately, gem faceting machines and tool sharpening apparatuses described above have limitations. The rotating abrasive disk used for faceting gems often has a surface that is not perfectly flat. Slight variations in the spinning surface result in facets that are not optimally placed or facets that have a slightly curved surface. Also, a spinning disk leaves curved scratches in the facets. These imperfections in the faceting process result in a gem that has reduced brilliance. Further, gem faceting machines are not useful for cutting facets into other materials, such as glass plates, blades, tools, and the like.

A disadvantage of the scraping-type of motion used in tool sharpeners is that the honing stone surface develops a concave shape with use, thus shortening the useful life of the honing stone. Another disadvantage is that the concave surface of the honing stone produces a cutting edge that is inconsistent since the cutting edge angle changes as the cutting edge moves through the concavity in the stone surface. Yet another disadvantage is that only a portion of the honing stone is used since the holder must be on the stone at the beginning of the honing process in order to insure that the cutting edge is positioned correctly relative to the honing surface. Further, blade sharpeners are not useful for faceting gem stones and the like.

Therefore, what is needed is a multi-purpose sharpening and faceting holder for use in manually sharpening or faceting an object that does not cause the development of a concave surface in the honing stone with extended use and that is adaptable for use with a variety of objects. The sharpening and faceting holder of the present invention improves on a sharpening holder for manually sharpening a cutting edge to be honed over a honing surface as disclosed in U.S. Pat. No. 7,549,910 (2009, to Stanley) and U.S. Pat. No. 7,335,093 (2008, to Stanley), the contents of which are incorporated herein by reference in their entirety.

It is an object of the present invention to provide a sharpening holder that allows a user to use substantially the entire surface area of the honing stone surface when manually honing or faceting.

It is another object of the present invention to provide a sharpening holder that does not cause the development of a concave honing surface in a honing stone when a cutting edge is sharpened using the sharpening holder.

It is a further object of the present invention to provide a sharpening holder that does not rely on "scraping" the cutting edge into the honing surface to achieve sharpening of the cutting edge.

The present invention achieves these and other objectives by providing a sharpening and faceting holder that has a body, an adjustable clamping component, and a plurality of roller members. In one embodiment of the present invention, the body is cylindrical and extends along a central longitudinal axis from a first end to a second end. The body has an opening extending transversely through the body between the first end and the second end. The opening has a tool support surface. The adjustable clamping component has a fastening plate positioned within the opening of the body. The fastening plate has a top surface, a tool engaging surface, and convex ends, where the convex ends define plate end openings extending generally towards a fastening plate center. The plate end openings being configured for receiving a first retaining pin and a second retaining pin, respectively. The fastening plate is configured to be positioned within the opening and rotatably adjustable about the fastening plate center. An adjustable fastener extends through the cylindrical body to engage the top surface of the fastening plate and to exert a holding force on the object to be sharpened or faceted. The tool engaging surface is configured to hold the object against the tool support surface of the body.

A first retaining pin extends longitudinally through a first elongated opening in the first end of the body to engage a plate end opening in the fastening plate. A second retaining pin extends longitudinally through a second elongated opening in the second end of the body to engage an opposed plate end opening in the fastening plate. First elongated opening and second elongated opening are aligned with each other. The plate end openings in the fastening plate permit the fastening plate to rotate about a longitudinal axis defined by the first and second retaining pins within the first and second elongated openings, respectively.

A plurality of roller members are attached to a lower portion of the body below the opening. The plurality of roller members are configured to allow the body to roll longitudinally on the honing surface causing the cutting edge to move parallel to the honing surface instead of perpendicular to the honing surface. More specifically, the axis of rotation of the plurality of roller members is perpendicular to the longitudinal axis of the cutting edge to be sharpened. The plurality of roller members may also be configured to allow the body to roll through an arc on the honing surface to provide "parallel" like sharpening of a curved cutting edge.

The plurality of roller members may be permanently attached or, preferably, removably attached. Optionally, a raceway may be used to house the plurality of roller members. The raceway is preferably formed at an inclined angle to the tool support surface.

In another embodiment of the present invention, the body is cylindrically shaped with an elongated recess or an elongated opening that extends transversely through or into the cylindrical body. The elongated recess or elongated opening has a cutting tool receiving surface with an adjustable clamping mechanism that includes a fastening plate or a plurality of tool fasteners such as, for example, hold-down screws for securely and removably holding a cutting blade in the body of the sharpening holder. A plurality of roller members are rotatably connected in a raceway formed into the surface of the body in a longitudinal direction. The raceway is formed at an angle to the cutting tool receiving surface. The rotational axis of the plurality of roller members is perpendicular to the raceway, which is also perpendicular to the cutting edge of a cutting blade mounted in the holder so that the rolling direction of the plurality of roller members is parallel to the longitudinal axis of the cutting edge.

In one embodiment, the tool engaging surface or bottom surface of the fastening plate has a concave V-shape to more easily align various sizes and shapes of cutting tools. In one embodiment, a tool engaging recess extends transverse to a central longitudinal plate axis.

In another embodiment, the top surface of the fastening plate also includes a plurality of skew angle indicia disposed onto or formed into the top surface. The skew angle indicia are also preset or indexed skew angle indicators. The end openings in the fastening plate are positioned and aligned to match the preset, skew angle indicia. In a further embodiment of the present invention, there is disclosed a method of adjusting a skew angle of a fastening plate for a sharpening and faceting holder. The method includes obtaining a sharpening and faceting holder having a cylindrical body with a first elongated opening in a first end, a second elongated opening in a second end, an opening formed transversely through the cylindrical body between the first end and the second end, a fastening plate positioned within the opening and having convex ends with a plurality of plate end openings, an adjustable fastener extending through the cylindrical body and engaging a top surface of the fastening plate, a first retaining pin and a second retaining pin extending through the respective first elongated opening and the second elongated opening, and a plurality of roller members disposed longitudinally and aligned to roll in a direction parallel to a longitudinal axis of the cylindrical body. The method also includes removing the first retaining pin and the second retaining pin from the fastening plate, selecting one of a predefined skew angle of the fastening plate, rotating the fastening plate to the selected skew angle, and reinserting the first retaining pin through the first elongated opening into a plate end opening that matches the selected skew angle and the second retaining pin through the second elongated opening into a plate opening that matches the selected skew angle.

The unique feature of the present invention in all its embodiments is the ability to sharpen the cutting edge of a blade or tool using a sideways motion with the sharpening holder that is parallel to the cutting edge of the blade or tool when manually sharpening a tool on a stationary honing stone surface, referred to herein as a "parallel sharpening motion." In other words, the rotational axes of the roller members are perpendicular to the longitudinal axis of the cutting edge. The prior art devices require a sharpening motion that is perpendicular to the cutting edge and, for those prior art devices that use roller members, the rotational axis of the roller members of the prior art is parallel to the cutting edge of the cutting tool. The parallel sharpening motion has the added advantage that it does not create a concavity in the honing stone surface with use over time like that created by prior art devices.

Another feature of the present invention is the relationship of the cutting edge of an object mounted in the body to the plurality of roller members. The plurality of roller members is positioned preferably at a predetermined angle to the bottom of the body so that the distance between the cutting edge to be sharpened and the points of contact of the roller members with the honing stone surface is less than one-half the width of the honing stone. This feature provides another advantage of the present invention in that it allows sharpening over substantially the entire honing stone surface.

Yet another feature of the present invention is the ability of the holder to hold an object for sharpening or faceting, whether the object is a tool, blade, gemstone, glass, or other object. Still another feature of the present invention is the ability to hold an object to be sharpened when the cutting edge or facet on the object defines a complex angle with respect to the honing stone surface. For the purposes of this application, a cutting edge or facet that defines a complex angle is one in which the facet defines a bevel angle and where the edge of the facet is inclined with respect to the central axis of the tool or object. For example, a chisel with a tip that is inclined to the chisel handle defines a complex angle because the chisel blade defines a bevel angle and the chisel tip is inclined with respect to the axis of the chisel handle. Thus, as the chisel tip is brought into contact with a honing stone surface, more than one pivot point must be considered so that the entire tip of the chisel contacts the honing stone surface and with the desired bevel angle.

DETAILED DESCRIPTION OF THE PREFERRED EMBODIMENT

Figure 1:
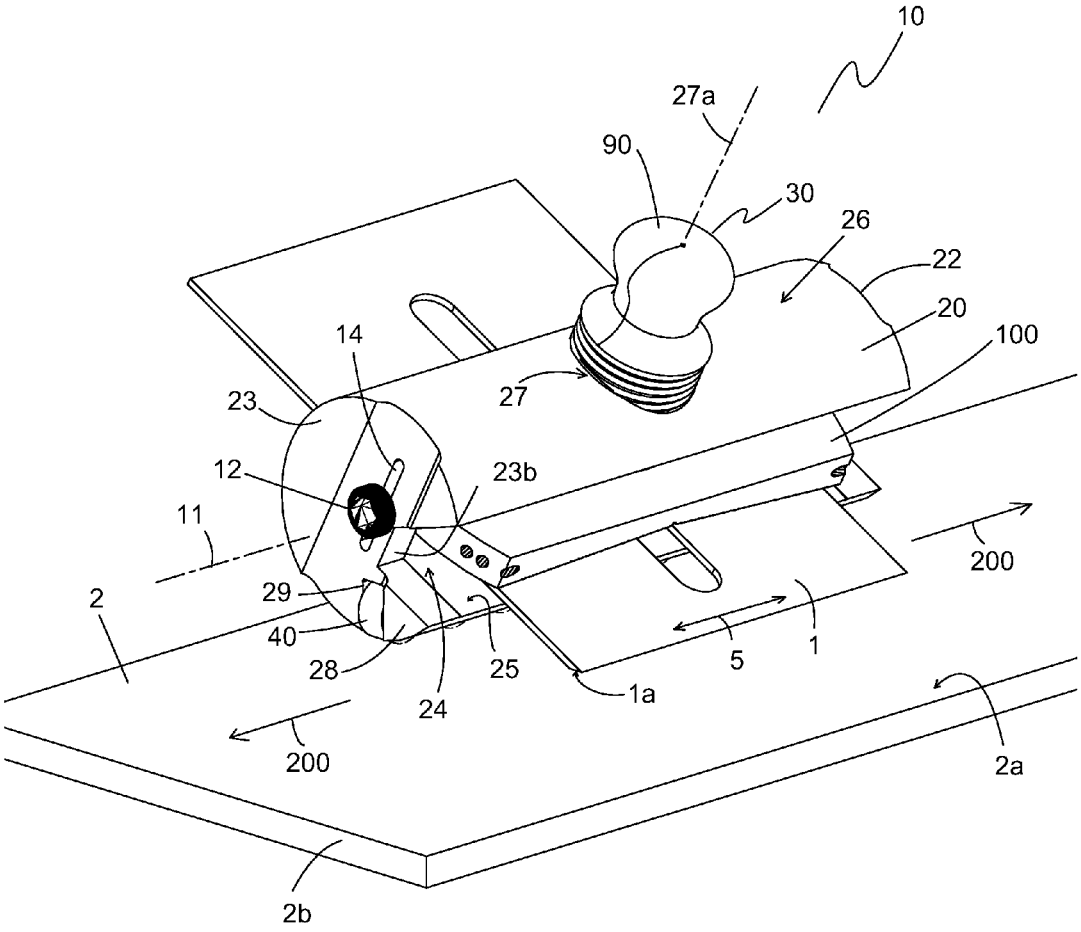
FIG. 1 is a perspective view of one embodiment of a holder of the present invention shown with a blade mounted in the holder and positioned atop a honing stone.

The preferred embodiments of the present invention are illustrated in FIGS. 1-8. FIG. 1 shows one embodiment of a sharpening holder 10 of the present invention with a blade 1 mounted therein for sharpening. Sharpening holder 10 has a body 20, an adjustable clamping component 30, and a plurality of roller members 40. Body 20 in one embodiment is cylindrical and extends along a central longitudinal axis 11 between a first end 22 and a second end 23. An opening 24 extends transversely through body 20 between first end 22 and second end 23 and defines a tool support surface 25 within opening 24. Blade 1 has a cutting edge 1*a* with a longitudinal cutting edge axis 5. First and second ends 22, 23 include a first and second elongated openings 22*a*, 23*a*, respectively, for receiving a fastening plate pin 12. First and second ends 22, 23 also include a first and second end slots 22*b*, 23*b* that communicates with through opening 24. First and second end slots 22*b*, 23*b* are configured to accommodate cutting blades that are wider than through opening 24.

Adjustable clamping component 30 includes a fastening plate 100 and an adjustable fastener 90. Adjustable fastener 90 extends through a top surface 26 of body 20 to engage fastening plate 100 and to impart a holding force so that fastening plate 100 secures cutting blade 1 against the tool support surface 25. Opening 24 of body 20 and fastening plate 100 may be sized to accommodate a variety of items. Although various adjustable fasteners may be used to engage fastening plate 100, adjustable fastener 90 is preferably a threaded thumb screw or the like that engages fastening plate 100 through a thumbscrew opening 27 (preferably threaded) that extends along thumbscrew opening axis 27*a* through top surface 26 of body 20. A pair of fastening plate pins 12 extend through first and second elongated openings 22*a*, 23*a* and into respective fastening plate ends, which are described below.

Roller members 40 are connected to a lower portion 28 of body 20 below opening 24. In one embodiment, roller members 40 are received in a longitudinal raceway 29 in lower portion 28 of body 20. The plurality of roller members 40 extend substantially between first end 22 and second end 23 of body 20. Each of the plurality of roller members 40 are freely rotatable and are aligned to provide body 20 with a sideways rolling action (indicated by arrows 200) parallel to central longitudinal axis 11 of body 20. All roller members 40 protrude out of raceway 29 a predefined distance. An important feature of the plurality of roller members 40 is that the roller members 40 must be sufficiently exposed to allow body 20 to not only roll sideways but also to allow body 20 to pivot through a selected angular range with the pivot point being the points of contact between the roller members 40 and a honing surface 2*a* of a honing stone 2. Roller members 40 that are usable in sharpening holder 10 include wheels, ball bearings, cylindrical rollers, tapered rollers, and the like.

The number of roller members 40 connected to body 20 depends on the size of roller members 40 and the size (i.e. length, width, diameter, etc.) of body 20. The size of body 20 depends on the type and size of the blade or tool to be sharpened and the size of the honing stone surface 2*a*. The width of body 20 should be less than that of sharpening surface 2*a* to allow sufficient sideways sharpening motion. The number of roller elements 40 is chosen to provide stability to body 20 when it engages sharpening surface 2*a* in the sideways sharpening motion. In the preferred embodiment, wheels are the roller members of choice.

In one embodiment, opening 24 may be only a recess with a clamping mechanism. The clamping mechanism is, for example, a plurality of hold-down screws to hold a cutting tool, such as the cutting blade of a planer. As recognized by those of ordinary skill in the art, cutting blades on electric or power planing tools have typically longer cutting edges when compared to their transverse dimension. Thus, the transverse dimension or width of the electric planing cutting blades does not require sharpening holder 10 to have a through opening 24 but simply a recess or clamping slot of sufficient size to accommodate such cutting blades. As previously disclosed, first and second end slots 22*b*, 23*b* are configured for use with such cutting blades.

Figure 2:
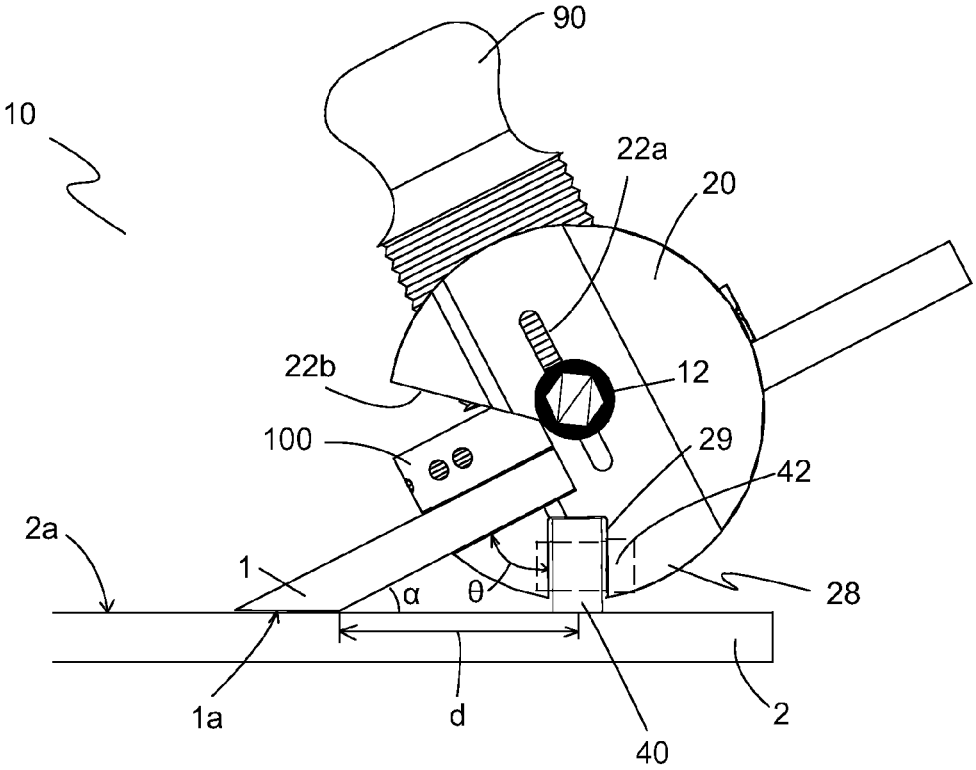
FIG. 2 is a side view of the embodiment of FIG. 1.

Turning now to FIG. 2, a side view illustrates sharpening holder 10 with blade 1 and honing plate 2. From this side view, second elongated opening 22*a*, second end slot 22*b* and pin 12 through second elongated opening 22*a* are shown. Raceway 29 is formed or machined in lower portion 28 of body 20 and extends parallel to central axis 11 (shown in FIG. 1). Each roller member 40 is supported by an axle 42 extending transversely across raceway 29 and through the opening of roller member 40. Raceway 29 and roller members 40 extend into body 20 at a preset angle θ relative to the support surface 25 of body 20. Angle θ is preferably in the range of about 45° to about 75°, more preferably between about 60° to about 70°.

Sharpening holder 10 is pivoted about contact points between roller members 40 and honing stone surface 2*a* so that both roller members 40 and cutting edge 1*a* contact honing stone surface 2*a*. The distance d between cutting edge 1*a* and the plurality of roller members 40 depends on the bevel angle α of cutting edge 1*a*. Bevel angle α is normally within a range of bevel angles typically observed for a knife blade and a scraper. The range is typically between about 21° (knife edge) and 32° (scraper). For wood planing blades, the bevel angle is about 27°.

As previously mentioned, sharpening holder 10 can be sized for the type of tool or blade to be sharpened as well as the size of the honing stone surface. The sharpening holder 10 is preferably structured so that the distance "d" illustrated in FIG. 2 between roller members 40 and cutting edge 1*a* is less than one-half of the honing stone width. This allows the entire honing stone surface 2*a* to be used for sharpening, which in turn allows the entire honing stone surface 2*a* to wear evenly and to avoid the wear concavity caused by prior art sharpening holders and jigs.

It is also noted that the distance that cutting edge 1*a* extends out of sharpening holder 10 can be adjusted to change the pivot angle between sharpening holder 10 and honing stone surface 2*a*. This adjustability allows sharpening holder 10 to be used to sharpen blades or tools with cutting edges that differ from one blade or tool to another. The allowed pivot angle of sharpening holder 10 is directly related to the size of the plurality of roller members 40 as well as the distance the roller members 40 extend from sharpening body 20.

Figure 3:
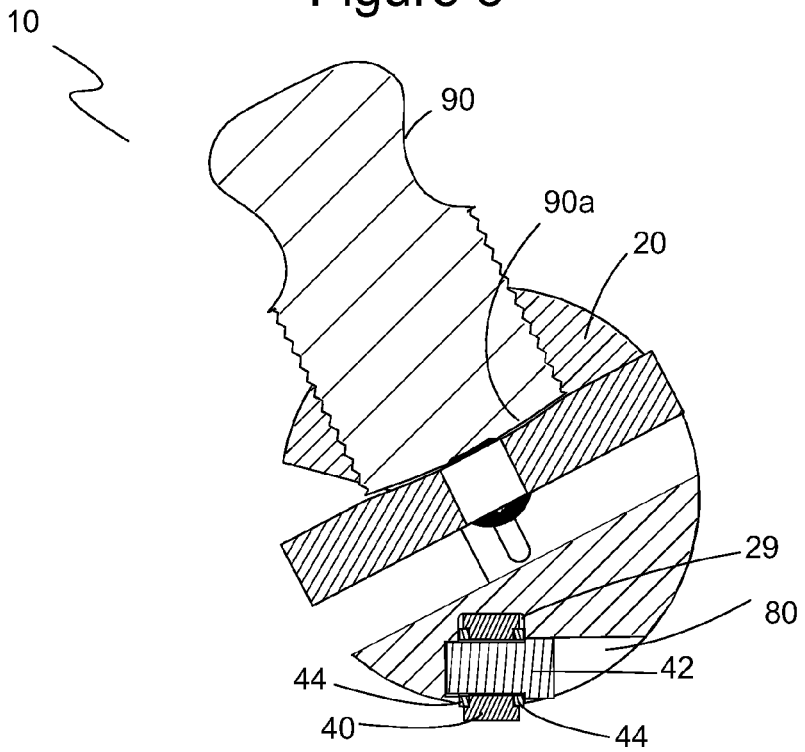
FIG. 3 is a side sectional view of the holder of FIG. 1 shown without the blade or honing stone.

FIG. 3 shows a cross-sectional view taken transversely through the longitudinal center of holder 10 of FIG. 1 and is illustrated without blade 1 or honing stone 2. In this view, adjustable fastener 90 has an engaging end 90*a*. An axle opening 80 is formed into the curved surface of body 20 for each axle 42. In one embodiment, each roller member 40 is supported between shim washers 44 by axle 42 extending through the opening in roller member 40 and the opening of shim washers 44. In another embodiment, a single axle opening 80 or slot may be used that accommodates a plurality of roller members or all of roller members 40.

Figure 4:
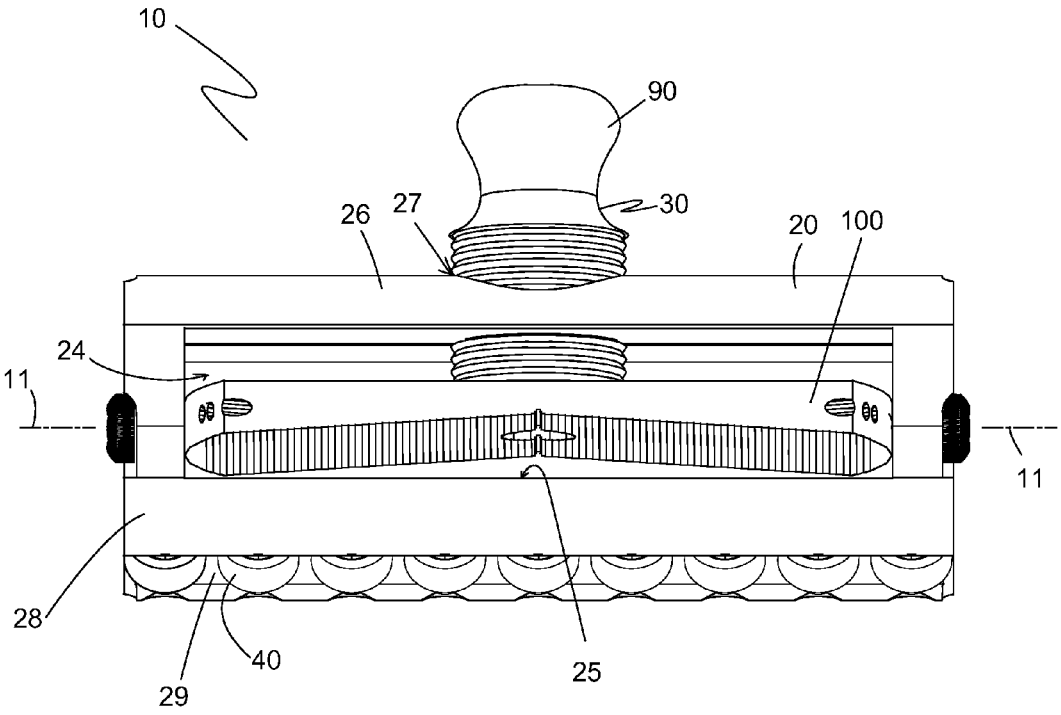
FIG. 4 is a front view of a holder of the present invention as viewed from slightly below the opening showing the plurality of rollers and the fastening plate.

Turning now to FIG. 4, a front view is illustrated of sharpening holder 10. Adjustable clamping component 30 includes a fastening plate 100 and adjustable fastener 90. Adjustable fastener 90 engages fastening plate 100 and imparts a holding force on a tool or other item to secure the item against tool support surface 25. Although various adjustable fasteners may be used to engage fastening plate 100, adjustable fastener 90 is preferably a thumb screw that engages fastening plate 100 through a threaded opening 27 in an outer or top surface 26 of body 20. Adjustable fastener 90 has a contoured shape that allows a neck portion 90*a* to rest comfortably between a thumb and a first finger of a hand for holding sharpening holder 10 during a hand sharpening operation.

The plurality of roller members 40 are connected to a lower portion 28 of body 20 below opening 24. Each of the plurality of roller members 140 are freely rotatable and have an axis of rotation that is perpendicular to the central longitudinal axis 11 of body 20 as well as to cutting edge 1*a* of a tool 1 (shown in FIG. 1) mounted in sharpening holder 10.

Roller members 40 are positioned within raceway 29 that extends longitudinally along body 20. The longitudinal length of body 20 should be shorter than the longitudinal honing stone surface 2*a* to allow sufficient sharpening motion. The number of roller elements 40 used is chosen to provide stability to body 20 when it engages honing stone surface 2*a* during sharpening or faceting.

Figure 5:
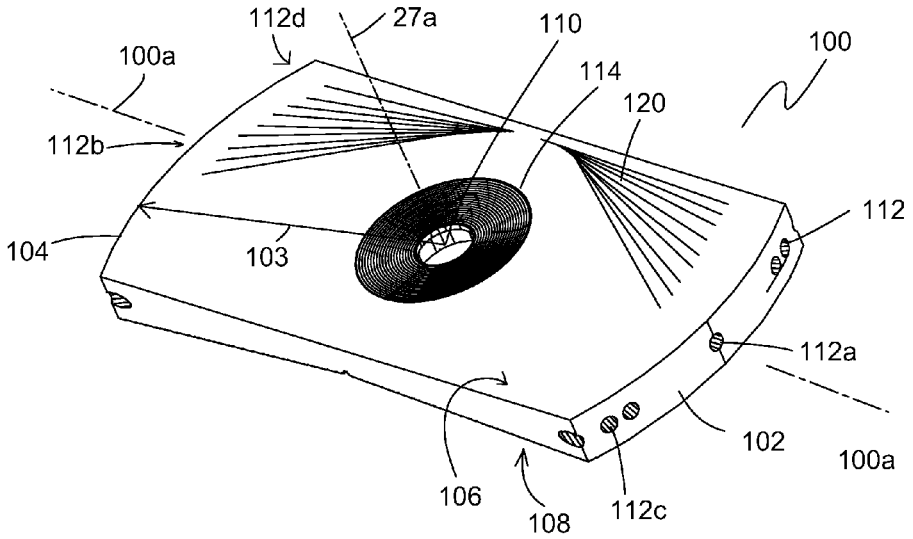
FIG. 5 is a perspective view of one embodiment of a fastening plate of the present invention showing a top surface and features of one of the concave ends.

Turning now to FIG. 5, there is illustrated a perspective view of one embodiment of fastening plate 100. Fastening plate 100 is sized to fit within opening 24 of body 20 along with the item to be sharpened. As viewed from above, fastening plate 100 extends along a central longitudinal plate axis 100*a* and has a generally-rectangular shape with convex ends 102, 104. Convex ends 102, 104 are positioned opposite each other and extend generally transverse to central longitudinal plate axis 100*a*. In one embodiment, convex ends 102, 104 each have a consistent radius 103 from plate center 110 to any point on convex end 102, 104. It is also acceptable for convex ends 102, 104 to have radius 103 that changes in value for various points on each of convex ends 102, 104. Preferably, the shapes of convex ends 102, 104 mirror each other.

Fastening plate 100 has a top plate surface 106 and a bottom plate surface 108. Top plate surface 106 is engaged by adjustable fastener 38 (shown in FIG. 1) while bottom plate surface 108 engages the blade or tool to hold it against tool support surface 25. A plurality of plate end openings 112 extend partially into fastening plate 100 generally towards plate center 110. Each end opening is sized to receive retaining pin 12 that extends through elongated openings 22*a*, 23*a* in a respective first end 22 or second end 23 of body 20. Opposite pairs of plate end openings 112 are positioned in convex ends 102, 104 so that pins 12 extending into the openings 112 permits fastening plate 100 to pivot on pins 12 in opening 24. When used, pins guide the movement of fastening plate 100 along first and second elongated openings 22*a*, 23*a*. The various locations of opposing pairs of plate end openings 112 enable fastening plate 100 to be rotatably adjusted about plate center 110, which coincides with thumbscrew opening axis 27*a*. The position of plate end openings 112 also coincide with predefined skew angle indicia on top plate surface 106, which represent the more common blade angles encountered. It should be understood that if skew angles other than the predefined skew angles may also be used. In these cases, pins 12 are not used since there will be no matching plate end openings 112. Alternatively, convex ends 102, 104 may include a slot along the length of the ends to accept pins 12, if desired.

Due to radius 103 discussed above, convex ends 102, 104 are shaped so that respective points on ends 102, 104 opposite of plate center 110 are separated by the same or about the same distance. For example, plate end openings 112*a*, 112*b* are separated by the same or about the same distance as plate end openings 112*c*, 112*d*. Thus, pins 12 retain fastening plate 100 in opening 24 of body 20 with central longitudinal plate axis 100*a* oriented parallel to central longitudinal axis 11 of body 20 or at a predefined angle with respect to central longitudinal axis 11.

Top plate surface 106 includes an optional fastener recess 114 for receiving engaging end 90*a* of adjustable fastener 90. Optional fastener recess 114 prevents fastening plate 100 from inadvertently sliding while engaged by adjustable fastener 90, especially when a blade/tool is being sharpened. In one embodiment, fastener recess 114 has a concave shape. Fastener recess 114 is preferably centered on plate center 110.

Figure 6:
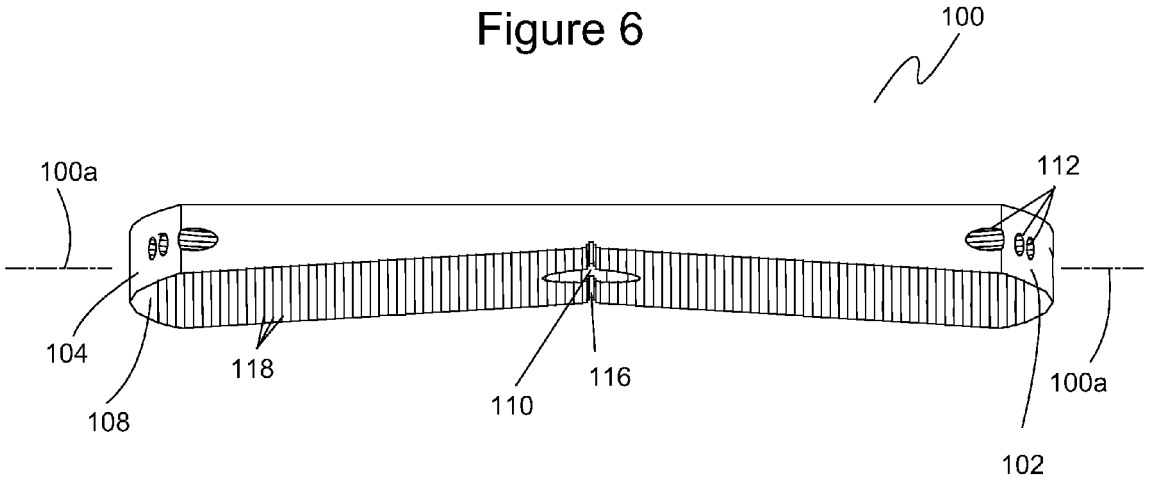
FIG. 6 is a front, perspective view of the fastening plate of FIG. 5 as viewed from below and showing a stepped bottom surface and a tool engaging recess.

Turning now to FIG. 6, a front view is shown from below bottom plate surface 108 of fastening plate 100. Bottom plate surface 108 has an optional tool engaging recess 116, which is preferably a V-shaped recess, slot, or groove formed in bottom plate surface 106 and that extends transversely to central longitudinal plate axis 100*a* and aligned with plate center 110. Similar in purpose to optional fastener recess 114, tool engaging recess 116 prevents the item to be sharpened from slipping sideways during sharpening. Fastening plate in a rotated orientation can hold a tool, dopstick, or substrate aligned with tool engaging recess 116 to accommodate a facet that defines a complex angle with respect to honing stone surface 2*a*.

In other embodiments, one or more tool engaging recesses 116 extend transversely across bottom surface 108 at an angle from about forty-five to about ninety degrees to central longitudinal plate axis 100*a*. A tool engaging recess 116 extending transversely at such an angle provides an additional way to hone objects with compound angles without having to change the orientation of fastening plate 100.

Bottom plate surface 108 also optionally includes a plurality of bottom plate grooves or parallel steps 118. Optional bottom plate grooves 118 enhance the holding capability of fastener plate 100. The edges of the item to be sharpened preferably rest within the bottom plate grooves 118, which further restrict any sideways movement of the item. It has been found that the preferred spacing of optional bottom plate grooves 118 is 1/32" (about 0.03" or 0.8 mm).

Fastening plate 100 has several unique features. The features include convex ends 102, 104 along the width of fastening plate 100, a V-shaped bottom plate surface 108 where the vertex of the V-shape extends transversely across the width of fastening plate 100, a plurality of plate end openings 112 located along the convex ends 102, 104 and extending into fastening plate 100 generally towards plate center 110, and a skew-angle scale 120 (shown in FIG. 5) on the top plate surface 106. Opposite plate end openings 112 allow fastening plate 100 to pivot on pins 12 when pins 12 are used in order to accommodate cutting blades or faceting holders that are tapered or have varying cross-sectional widths/thicknesses. Convex ends 102, 104 have an arc radius that allows fastening plate 100 to pivot about the rotational axis of adjustable fastener 90. This pivotal rotation, coupled with the V-shaped bottom plate surface 108, allows a user to mount a cutting edge having a skew angle on the cutting blade of the tool. The plurality of plate end openings 112 are positioned along convex ends 102, 104 to provide indexed/preset skew angles of, for example, 20°, 25° and 30°. The skew-angle scale 120 further provides a plurality of skew angle indicia including, for example, 5° to 45° markings in 5° increments. The skew angle indicia, which are preferably indicator lines, are positioned to align with the longitudinal edge of opening 24 in body 20.

The configuration of fastening plate 100 is extremely versatile such that sharpening holder 10 can be used to sharpen or facet a wide variety of items. This variety includes, but is not limited to, gemstones, glass, chisel-style knives, skew knives (pocket knives), thickness planer blades, power planer blades, skew carving tools, chisels, hand plane blades, straight razors, drill bits, razor blades, micro tools (the present invention can scale down to work on microscopically small tools), narrow chisels, very wide chisels, boat slicks, medical instruments, dental instruments, curets, checkering tools, gun smith tools, surgical instruments, scalpels, scalpels for woodworking, scrapers for painters, putty knives, painters scrapers, dissection tools/knives even with stone edges, potters knives and scrapers, gardening tools (hoe, madox etc.), scissors, machine part faceting, farmers knives, factory de-burring knives, and the like.

Figure 7:
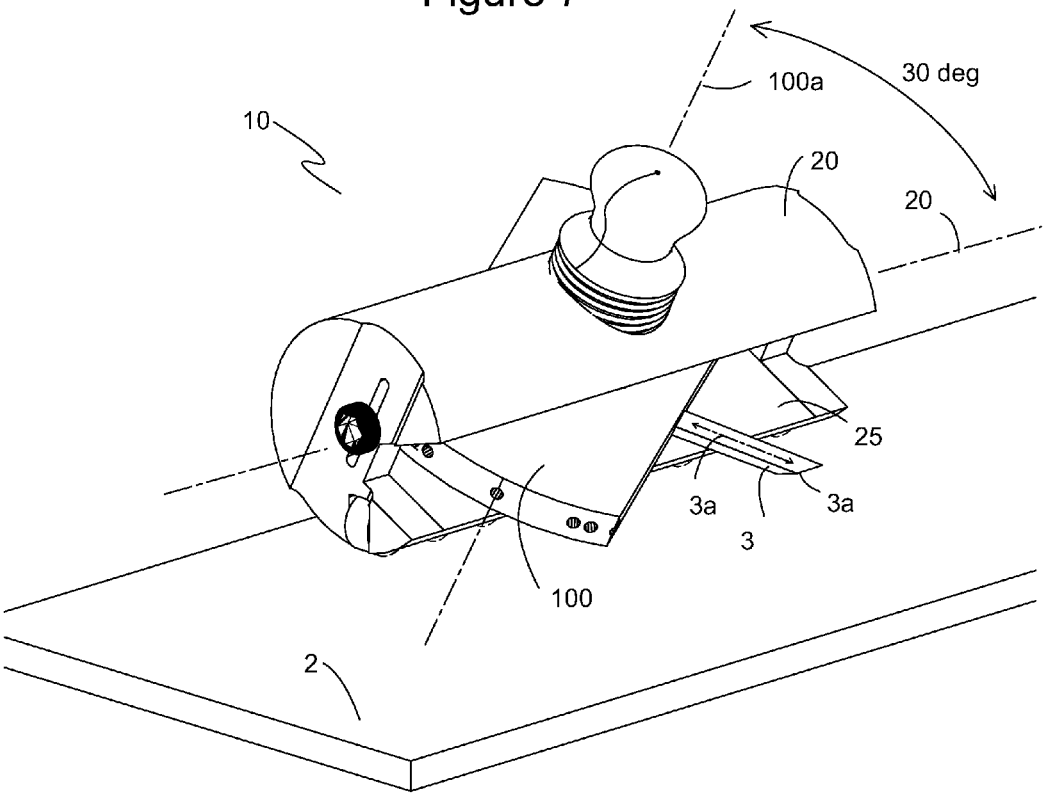
FIG. 7 is a perspective view of an embodiment of sharpening holder of the present invention shown with fastening plate oriented at an angle in the body opening for sharpening a cutting edge that defines a complex angle.

FIG. 7 illustrates an embodiment of sharpening holder 10 with central longitudinal plate axis 100*a* oriented at a thirty degree angle with respect to central longitudinal axis 11 of body 20. A blade 3 is secured in sharpening holder 10. Blade 3 has a cutting edge 3*a* that is inclined with respect to blade axis 3*b*, therefore defining a complex angle. Fastening plate 100 secures blade 3 against tool support surface 25 in a position where cutting edge 3*a* can be sharpened against honing stone 2.

Figure 8:
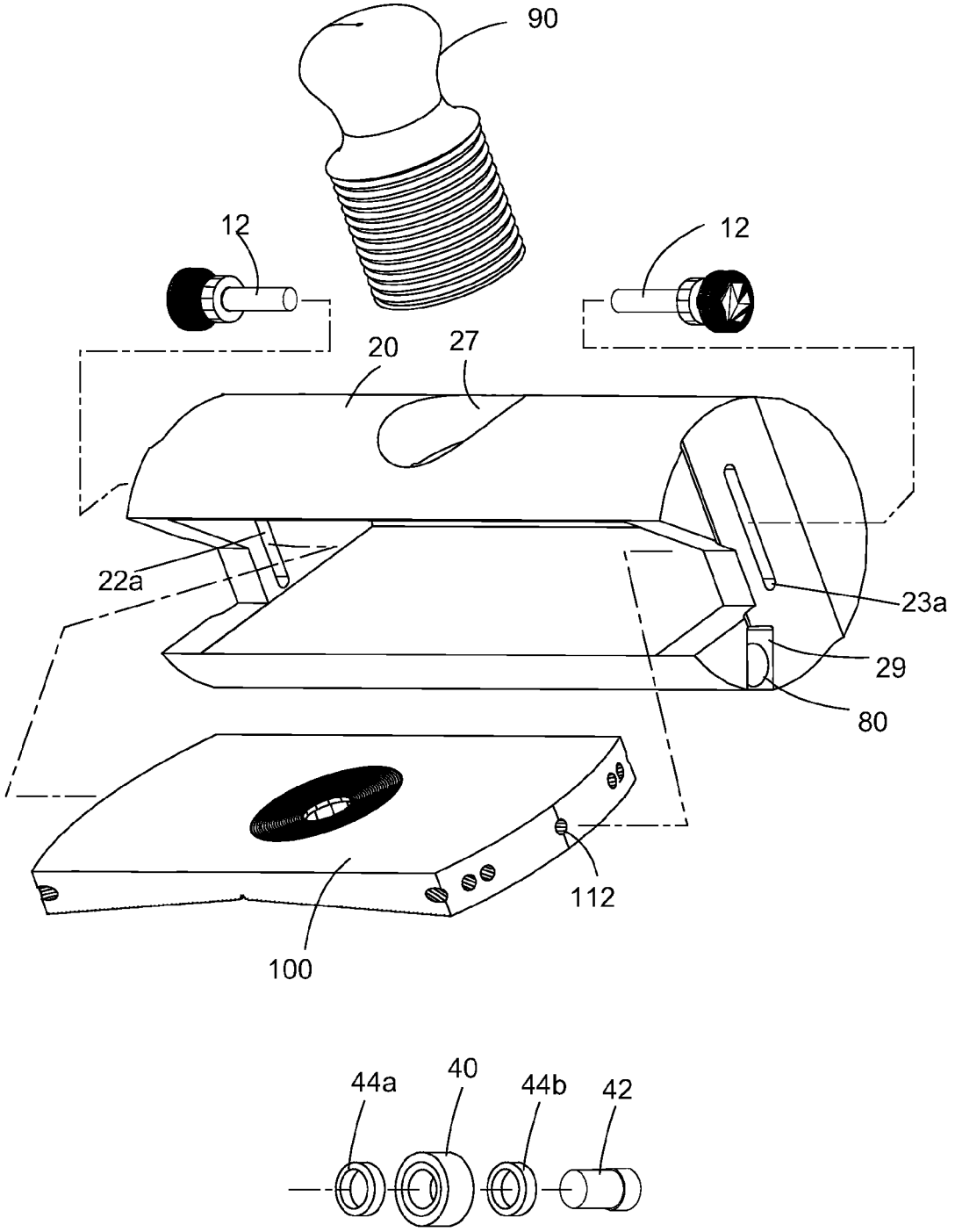
FIG. 8 illustrates an exploded, perspective assembly schematic of one embodiment of a sharpening holder of the present invention showing spatial relationships between various components of the holder.

FIG. 8 illustrates a perspective, exploded assembly schematic to show the relationship of various components of sharpening holder 10. Retaining pins 12 extend longitudinally through first and second elongated openings 22*a*, 23*a* to engage plate end openings 12 in fastening plate 100, thereby retaining fastening plate in opening 24 and providing a pivot axis defined by opposed pins 12. Adjustable fastener 90 is configured to be threaded into fastener opening 27 (threads of opening 27 not shown) to engage fastener plate 100. Axle 42 extends through opening 80 in body 20, then through first shim washer 44*a*, roller member 40, and second shim washer 44*b*, thereby retaining roller member 40 in raceway 29.

In use, the present invention is used with honing stone 2 to sharpen, for example, a planning blade 1 or to facet, for example glass or gemstone, mounted in sharpening holder 10. Planing blade 1 is placed through opening 24 below fastening plate 100 so that blade 1 rests upon tool support surface 25 with the bevel cutting edge 1*a* facing towards the honing stone surface 2*a*. Blade 1 and sharpening holder 10 are adjusted so that cutting edge 1*a* contacts honing stone surface 2*a*. Adjustable fastener 90 is then turned to secure blade 1 in sharpening holder 10. Once secured, blade 1 is sharpened by rolling sharpening holder 10 with the cutting edge 1*a* on honing stone surface 2*a* in the directions indicated by arrows 200 shown in FIG. 1.

A similar procedure is performed for faceting gemstones. A dopstick with a gemstone mounted to its end is inserted through opening 24 and aligned with tool engaging recess 116. The dopstick position is adjusted so that a portion of the dopstick and the gemstone protrude from opening 24. Adjustable fastener 90 is then turned to secure the dopstick against tool support surface 25 in sharpening holder 10. Once secured, the gemstone is faceted by rolling sharpening holder 10 with the gemstone against honing stone surface 2*a* in the directions indicated by arrows 100 shown in FIG. 1. For additional facets, fastening plate is oriented to provide a complex faceting angle on the gemstone. For example, fastening plate 100 is rotated to a 30° position and pins 12 are inserted in to the appropriate end openings 112 to retain it in holder 10. The dopstick is inserted through opening 24 and aligned with tool engaging recess 116, which is now inclined at 60° to the central longitudinal axis 11 of sharpening holder 10 rather than being perpendicular (90°). The gemstone is faceted by rolling sharpening holder 10 with the gemstone against honing stone surface 2*a*.

Unlike prior art hand or manual sharpening tools and jigs, the present invention provides skew angle pins that allows fastening plate 100 to pivot along a pivot axis defined by pins 12 inserted through first and second elongated openings 22*a*, 23*a* and into opposed plate openings 112 in fastening plate 100. The advantage of such a system is to allow use of blades and/or facet holders with varying thickness along the blade and/or facet holder while maintaining greater surface area contact of the fastening plate 100 with the blade and/or facet holder when in a clamped orientation. No other prior art device provides such an advantage. Other advantages of the present invention includes use with facet holders and for creating multiple facets on glass and/or gemstones.

Although the preferred embodiments of the present invention have been described herein, the above description is merely illustrative. Further modification of the invention herein disclosed will occur to those skilled in the respective arts and all such modifications are deemed to be within the scope of the invention as defined by the appended claims.

What is claimed is:

1. A sharpening and faceting holder for manually sharpening or faceting an object on a honing surface, the holder comprising:

a cylindrical body extending along a central longitudinal axis and having a first end, a second end and an opening formed transversely through the cylindrical body between the first end and the second end, the opening having a tool support surface;

an adjustable clamping component comprising:

a fastening plate extending along a central longitudinal plate axis and having a top surface, a tool support surface, and convex ends, wherein the convex ends define a plurality of plate end openings extending generally towards a fastening plate center, the fastening plate configured to be positioned within the opening and rotatably adjustable about the fastening plate center, wherein the fastening plate has the top surface and a tool engaging surface configured to hold the object against the tool support surface; and an adjustable fastener extending through the cylindrical body to engage the top surface of the fastening plate and configured to exert a holding force on the object;

a first retaining pin extending longitudinally through a first elongated opening in the first end and configured to engage one of the plurality of plate end openings;

a second retaining pin extending longitudinally through a second elongated opening in the second end and configured to engage an opposite one of the plurality of plate end openings; and a plurality of roller members disposed within a longitudinal raceway formed in a lower portion of the body below the opening, wherein the plurality of roller members are aligned to roll in a direction parallel to the longitudinal axis of the cylindrical body and wherein an axis of rotation of each of the plurality of roller members is perpendicular to the longitudinal axis of the cylindrical body.

2. The holder of claim 1 wherein the top surface of the fastening plate has a plurality of skew-angle indicia wherein a predefined selection of the skew angle indicia coincide with one of the plurality of predefined plate end openings of the fastener plate.

3. The holder of claim 1 wherein the raceway is inclined with respect to the tool support surface of the body.

4. The holder of claim 3 wherein an angle formed between the raceway and the tool support surface is in the range of about 55° to about 75°.

5. The holder of claim 1 wherein the plurality of roller members are selected from the group consisting of wheels, ball bearings, cylindrical rollers, and tapered rollers.

6. The holder of claim 1 wherein the tool engaging surface of the fastening plate has a tool engaging recess extending transversely to the central longitudinal plate axis.

7. A method of adjusting a skew angle of a fastening plate for a sharpening and faceting holder, the method comprising:

obtaining a sharpening and faceting holder having a cylindrical body with a first elongated opening in a first end, a second elongated opening in a second end, an opening formed transversely through the cylindrical body between the first end and the second end, a fastening plate positioned within the opening and having convex ends with a plurality of plate end openings, an adjustable fastener extending through the cylindrical body and engaging a top surface of the fastening plate, a first retaining pin and a second retaining pin extending through the respective first elongated opening and the second elongated opening, and a plurality of roller members disposed longitudinally and aligned to roll in a direction parallel to a longitudinal axis of the cylindrical body;

removing the first retaining pin and the second retaining pin from the fastening plate;

selecting one of a predefined skew angle of the fastening plate;

rotating the fastening plate to the selected skew angle; and reinserting the first retaining pin through the first elongated opening into a plate end opening that matches the selected skew angle and the second retaining pin through the second elongated opening into a plate opening that matches the selected skew angle.

* * * * *